US006129348A

United States Patent [19]

Park

[11] Patent Number: 6,129,348

[45] Date of Patent: Oct. 10, 2000

[54] DAMPED SHEET FEEDING DEVICE AND METHOD FOR AN ELECTROPHOTOGRAPHIC APPARATUS

[75] Inventor: Jin-Ho Park, Kyungki-do, Rep. of Korea

[73] Assignee: SamSung Electronics Co. Ltd., Suwon, Rep. of Korea

[21] Appl. No.: 09/182,204

[22] Filed: Oct. 30, 1998

[30] Foreign Application Priority Data

Nov. 4, 1997 [KR] Rep. of Korea ..... 97-57869

[51] Int. Cl.[7] ..... B65H 1/10; B65H 1/08

[52] U.S. Cl. ..... 271/160; 271/147

[58] Field of Search ..... 271/160, 147, 271/22, 24, 30.1, 126, 127, 128

[56] References Cited

U.S. PATENT DOCUMENTS

| | | | |
|---|---|---|---|
| 4,272,067 | 6/1981 | Yoshida et al. | 271/160 |
| 4,305,577 | 12/1981 | Clay et al. | 271/160 |
| 4,319,741 | 3/1982 | Okamoto | 271/160 |
| 4,930,763 | 6/1990 | Horii et al. | 271/147 |
| 5,564,690 | 10/1996 | Oshida | 271/160 |
| 5,815,787 | 9/1998 | Crayton et al. | 271/160 |
| 5,970,866 | 10/1999 | Okawa | 271/171 |

FOREIGN PATENT DOCUMENTS

| | | | |
|---|---|---|---|
| 000575996 | 12/1993 | European Pat. Off. | 271/160 |
| 0233422 | 9/1990 | Japan | 271/147 |
| 404313523 | 12/1992 | Japan | 271/160 |
| 406009070 | 1/1994 | Japan | 271/147 |
| 09278195 | 10/1997 | Japan . | |

OTHER PUBLICATIONS

Engioneering Mechanics, Dynamics, Second Edition; R.C. Hibbeler, Macmillan Pub., 1978.

*Primary Examiner*—Katherine A. Matecki
*Assistant Examiner*—Daniel K Schlak
*Attorney, Agent, or Firm*—Robert E. Bushnell, Esq.

[57] ABSTRACT

A sheet feeding device that uses an air damper for absorbing vibrations when a pick up roller contacts the tray and supported stack of paper. The air damper has a circular tube that has an opening formed in the base of the frame. A piston is then connected to the bottom surface of a tray that is supported in the frame. The piston is pivotally connected to the bottom surface of the tray and protrudes into the circular tube. A plunger is attached to the free end of the piston and maintains contact with the inner surface of the circular tube. The air damper reduces the amount of acceleration that the tray undergoes when the tray is free to move towards the pick up roller of the electrophotographic device.

20 Claims, 7 Drawing Sheets

DAMPED SHEET FEEDING DEVICE AND METHOD FOR AN ELECTROPHOTOGRAPHIC APPARATUS

CLAIM OF PRIORITY

This application makes reference to, incorporates the same herein, and claims all benefits accruing under 35 U.S.C. § 119 from my application entitled Auto Feed Device Using Air Damper of Inkjet Printer filed with the Korean Industrial Property Office on Nov. 4, 1997 and there duly assigned Serial No. 97-57869 by that Office.

BACKGROUND OF THE INVENTION

1. Field of the Invention

The present invention relates to a device for absorbing shocks and thereby reducing the noise that occurs during the feeding of sheets from a sheet feeding device into an electrophotographic apparatus and, more specifically, to a sheet feeding device that uses an air damper to reduce the noise and vibration generated during operation of the sheet feeding device.

2. Background Art

An image formation apparatus (e.g., a printer, scanner, facsimile or copier) must often accommodate printable mediums having a thickness or dimensions different from that of standard paper. Envelopes, postcards, transparencies, labels and resume paper are just a few examples of the different printable mediums that a sheet feeder must accommodate. A sheet feeder may be constructed to use a tray that supplies paper to a printer. The tray often has an adjustment lever allowing the paper to be moved away from a pickup roller in order to load additional sheets of paper into the tray. After loading additional paper, the adjustment lever is moved in a direction opposite that used for preparing the tray to receive additional paper causing the pickup roller to press against the paper on the tray and then transfer the paper to a transfer roller. Then, the transfer roller transports the sheet of paper to the printer cartridge.

Electrophotographic devices tend to use pick-up rollers to remove sheets from the sheet feeding device. However, when the tray is brought into contact with the pick-up roller a shock occurs due to the force provided by an elastic member to the tray. Some conventional devices use cams to gently move the tray up and down throughout the sheet feeding process. Such a process, however, often results in a lack of precision in the sheet feeding operation as the pick-up roller must load the paper before the cam finishes a predetermined portion of the cam's rotation.

As such, I believe that it may be possible to improve on the contemporary art by providing a sheet feeding device that reduces the vibration created by loading sheets, does not require the use of a cam, does not undergo greater vibration when a lesser amount of paper is stored on the tray, and that is economical to manufacture.

SUMMARY OF THE INVENTION

Accordingly, it is an object of the present invention to provide an improved sheet feeding device.

It is another object to provide a sheet feeding device that reduces the vibrations and noise created during the sheet loading operation.

It is still another object to provide a sheet feeding device that does not require the use of a cam.

It is yet another object to provide a sheet feeding device that does not undergo greater vibration during the sheet loading process when there is less paper loaded on the tray.

It is still yet another object to provide a sheet feeding device that is economical to manufacture.

It is a further object still to provide a sheet feeding device that can be used with a combination semicircular pick-up roller and a push down lever that depress a tray to prevent the loading of paper into an electrophotographic apparatus.

To achieve these and other objects, a sheet feeding device may be constructed with a frame that has an air damper recessed into the base of the frame. The air damper is a circular tube, or shaft, that has an opening formed in the base of the frame. A piston is then connected to the bottom surface of a tray that is supported in the frame. The piston is pivotally connected to the bottom surface of the tray and protrudes into the circular tube. A plunger is attached to the free end of the piston and maintains contact with the inner surface of the circular tube. The air damper reduces the amount of acceleration that the tray undergoes when the tray is free to move towards the pick-up roller of the electrophotographic device.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
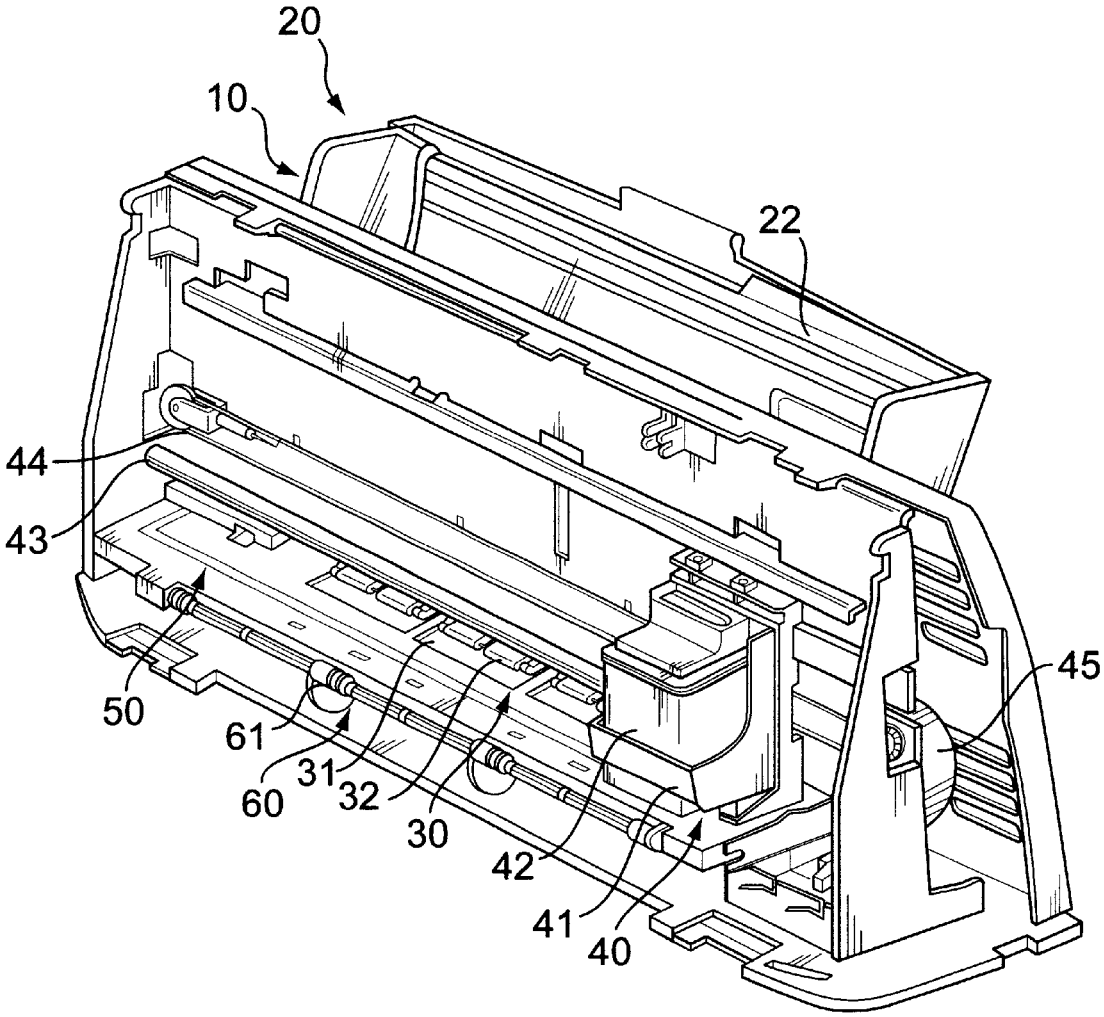
FIG. 1 is a perspective view of a printer.
Figure 2:
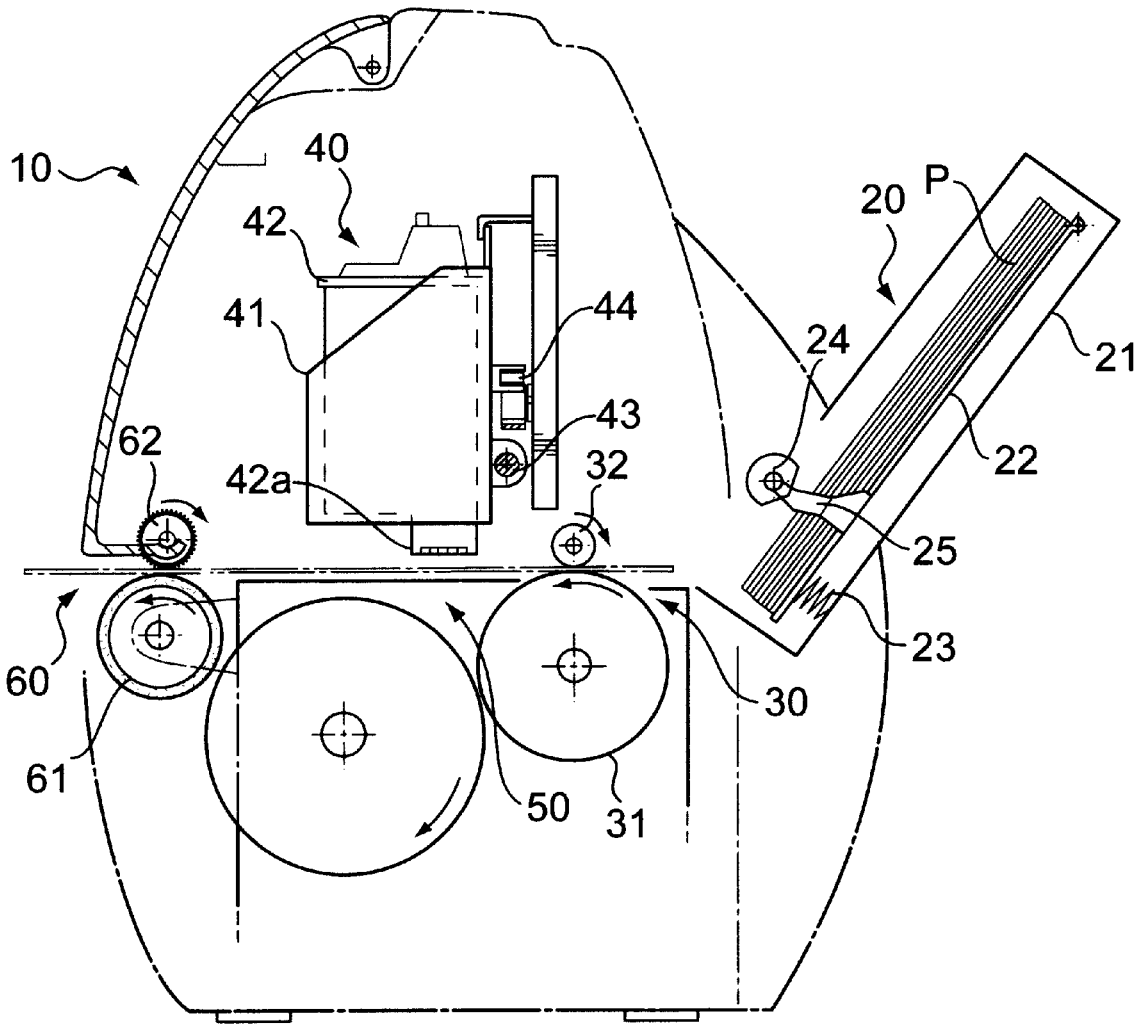
FIG. 2 is a side view of the printer of FIG. 1.
Figure 3:
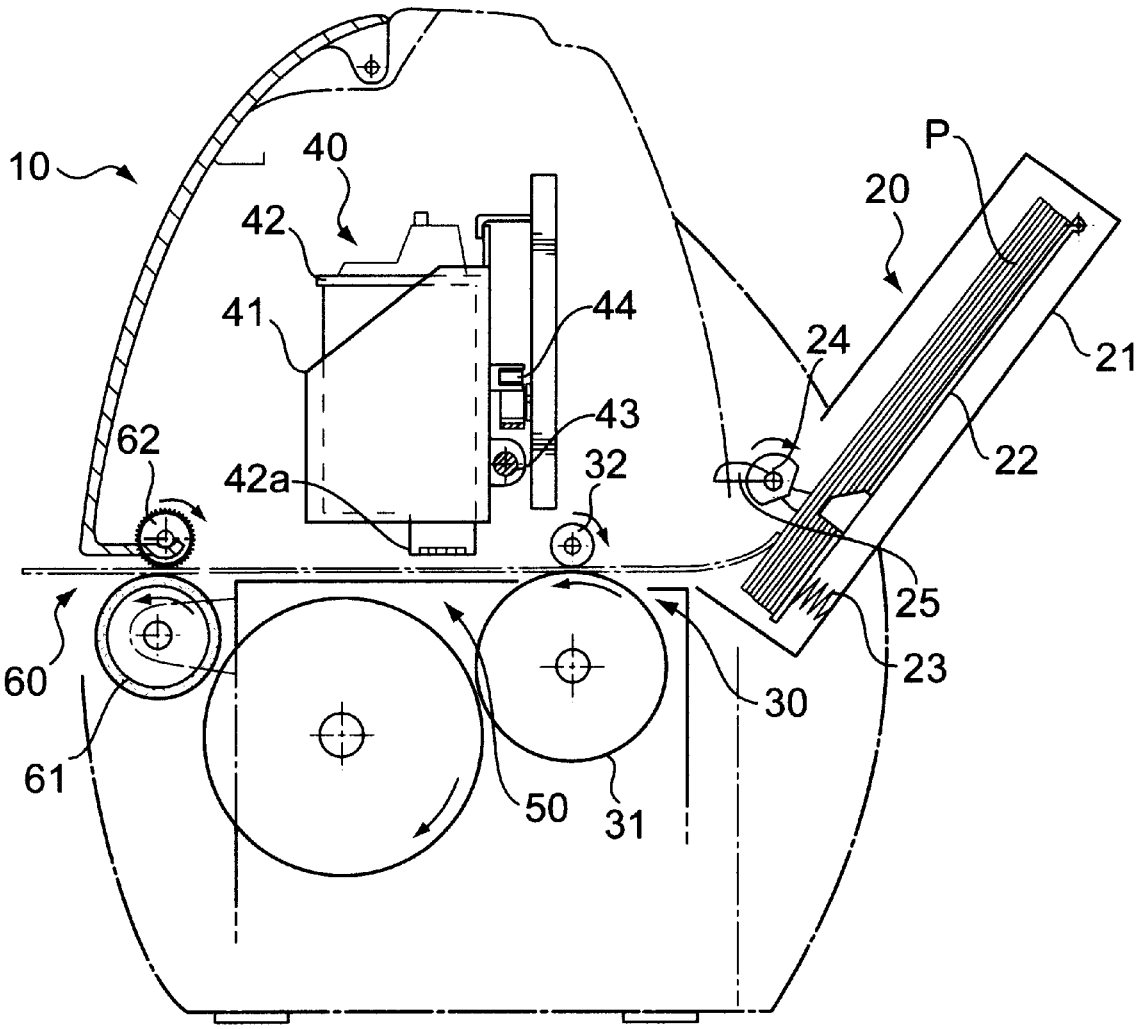
FIG. 3 is a side view of the printer of FIG. 1.

Turning now to the drawings, FIG. 1 illustrates a perspective front view a printer 10. FIG. 2 shows a printer preparing to load a sheet of paper and FIG. 3 is a side view of the printer of FIG. 2 loading a sheet of paper. Papers are loaded in tray 22 of frame 21 of sheet feeding device 20. As the amount of paper is increased, elastic member 23 is compressed. Tray 22 is pushed by pick-up cam 25 that is formed using semicircular roller 24 that rotates to feed paper into the printer 10, then the tray 22 with the paper gets to go up by the elastic member 23, and so to adhere closely to a cylindrical surface of the pick up roller 24. Pick-up roller 24 loads the paper stacked in tray 22 and transports the paper to paper path 30.

The paper transported through paper path 30 is transported to printing device 40 by the rotating pressure of feed roller 31 and friction roller 32. Then, a carriage driving motor (not shown) drives belt 44 in a reciprocal fashion. Carriage 41 is fixed to guide rail 46 and slides along the guide rail 46 in a reciprocating fashion along carriage shaft 45. Printing is performed on the paper that is transported along paper transport path 30 past nozzles 42*a* that are attached to head cartridge 42.

Subsequently, the head cartridge 42 completes the printing of images as the paper slowly moves by nozzles 42*a*. The paper is then transported to paper discharger part 60, and the paper is discharged after passing between discharge roller 61 and star wheel 62.

Figure 4:
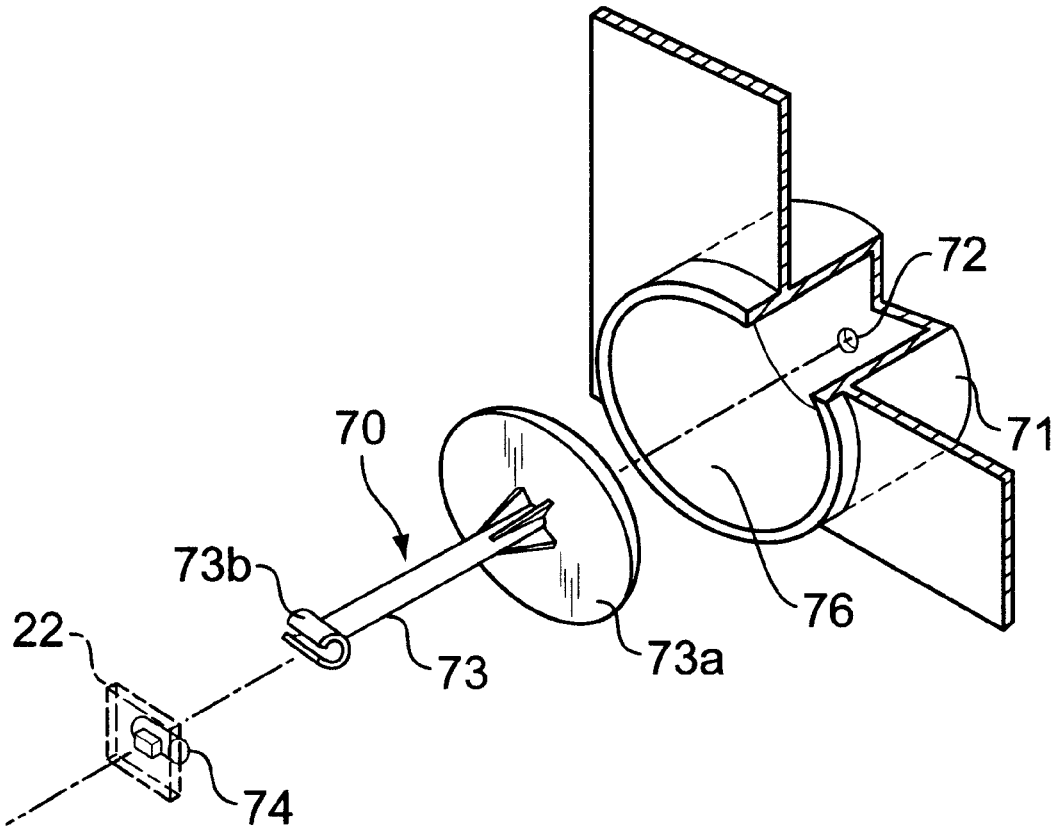
FIG. 4 is an exploded perspective view of the air damper as constructed according to the principles of the present invention.

FIG. 4 illustrates the structure of an air damper as constructed according to the present invention. Air damper 70 may be constructed using cylindrical boss 74 that is installed on the lower side of tray 22, a first piston 73 that is attached to cylindrical boss 74 and moves with the motion of tray 22. Circular tube 71 has a diameter that allows a second piston or plunger 73*a*, that is attached to an end of piston 73, to move upward and downward while maintaining contact with inner surface 76 of circular tube, or shaft, 71. The piston 73 is connected to cylindrical boss 74 using prongs 73*b*. Air vent 72 has a diameter designed to cause a predetermined amount of damping by the air damper 70.

Figure 5:
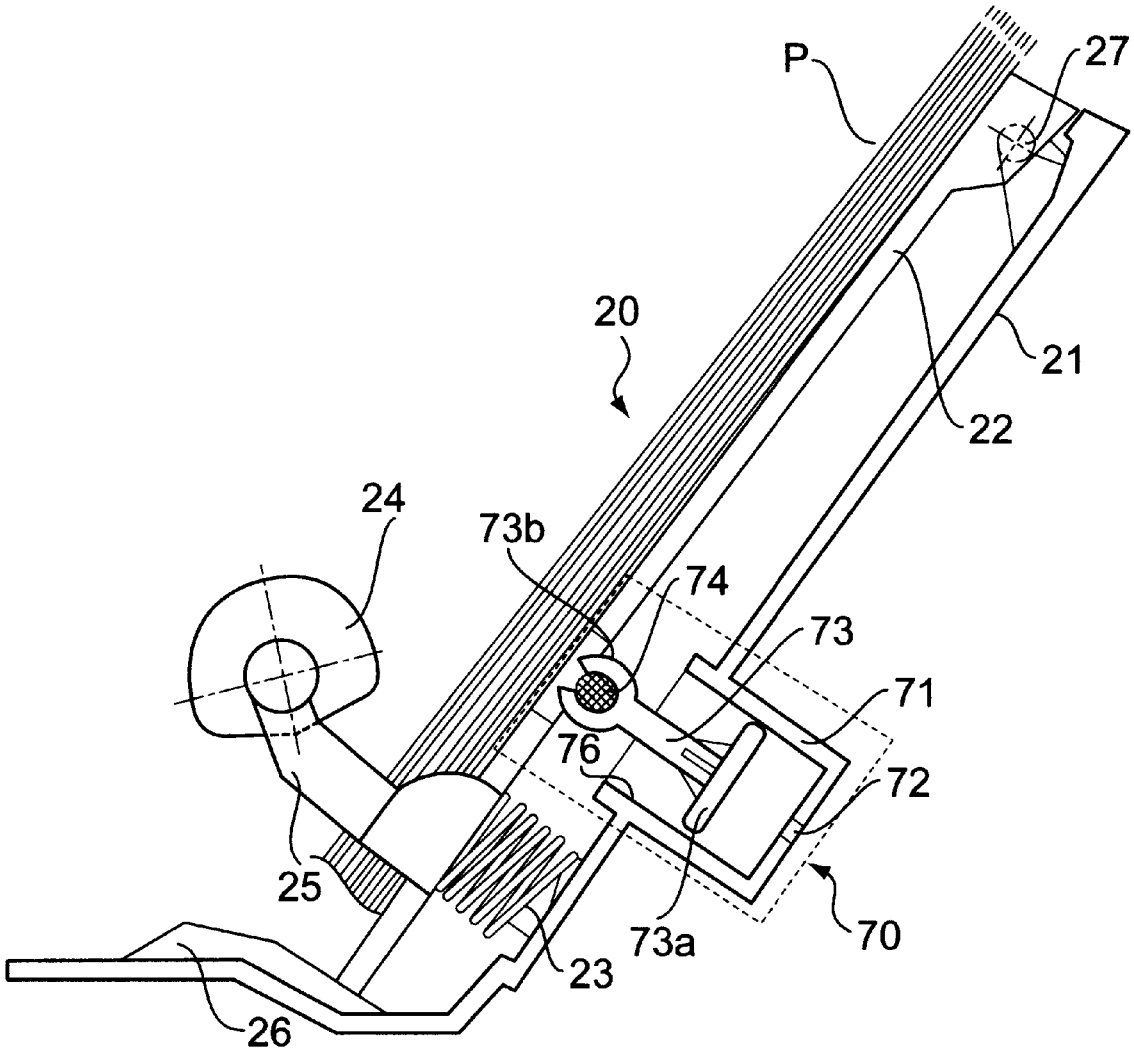
FIG. 5 illustrates the operation of the sheet feeding device of the present invention while paper is not being loaded into the electrophotographic apparatus.
Figure 6:
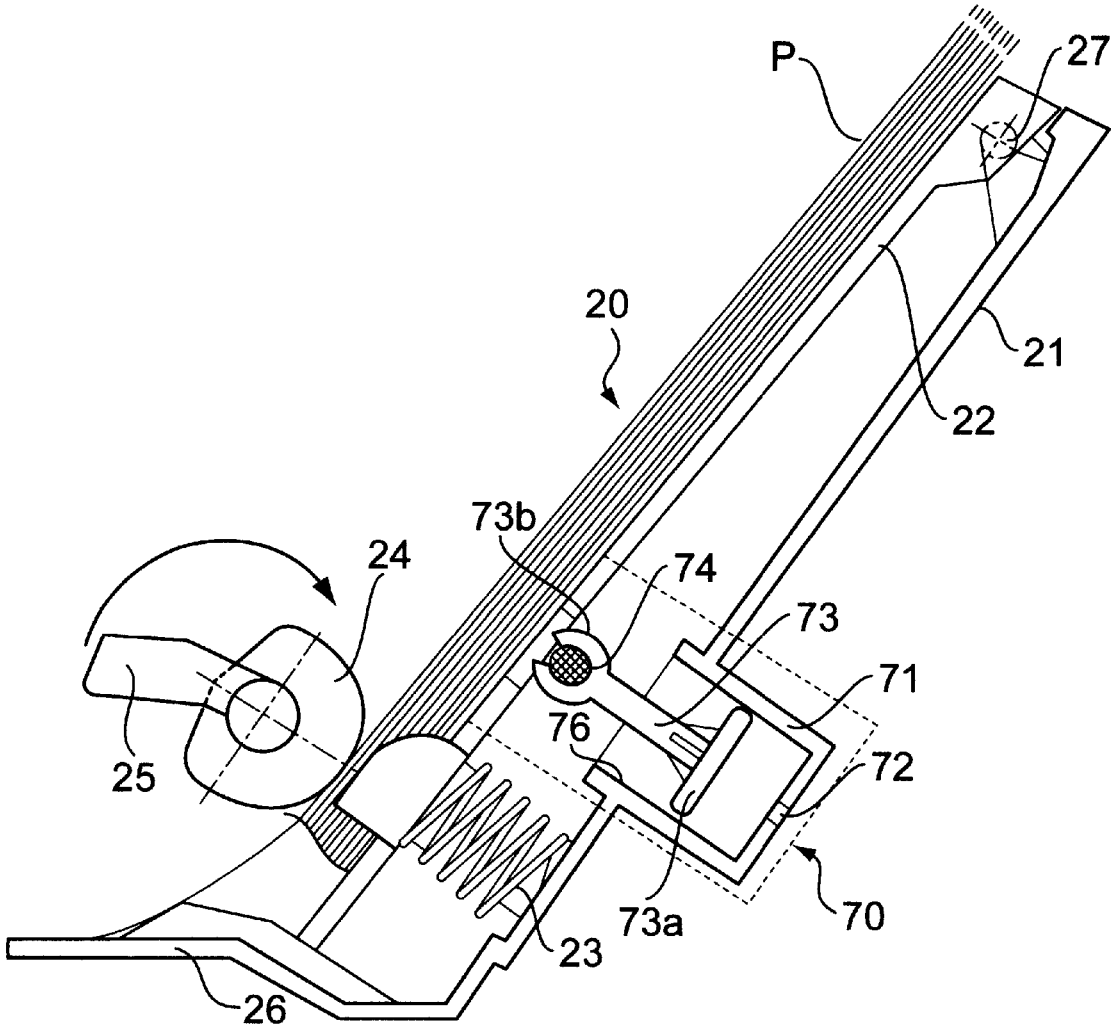
FIG. 6 illustrate the operation of the sheet feeding device of the present invention while paper is being loaded into the electrophotographic apparatus.

FIG. 5 shows the sheet feeding device of the present invention while not loading paper into the electrophotographic apparatus. FIG. 6 shows the sheet feeding device of the present invention while loading a sheet of paper into the electrophotographic device. Sheet feeding device 20 may be constructed using frame 21 that has air damper 70 recessed into the base of the frame 21. Air damper 70 may be constructed using circular tube, or shaft, 71 that has an opening formed in the base 21*a* of frame 21. Piston 73 is then connected to the bottom surface of tray 22 that is supported in frame 22. Piston 73 is pivotally connected to cylindrical boss 74 that is formed on the lower surface of tray 21, and protrudes into circular tube 71. Plunger 73*a* is attached to the free end of piston 73 and maintains contact with inner surface 76 of circular tube 71. Air damper 70 reduces the amount of acceleration that tray 22 undergoes when the tray 22 is free to move towards pick-up roller 24 of the electrophotographic device. Multi-faced guide 26 is located on frame 21 proximate to the pick-up roller 24 to maintain paper P in the correct position during loading into the electrophotographic device regardless of the quantity of paper P that is positioned on tray 22. Hinge 27 pivotally attaches tray 22 along a first end 22*a* of tray 22 to frame 21. Semicircular pick-up roller 24 loads sheets into the electrophotographic device in response to a print signal that is received by the electrophotographic device.

Elastic member 23 provides a biasing force separating tray 22 from the base 21*a* of frame 21. The air damper 70 provides a damping force to tray 22 after push down lever 25 is disengaged from tray 22. This lowers the shock generated, along with the associated noise, when elastic member 23 forces tray 22 towards pick-up roller 24 until the paper stack comes into contact with the pick-up roller 24.

Figure 7A:
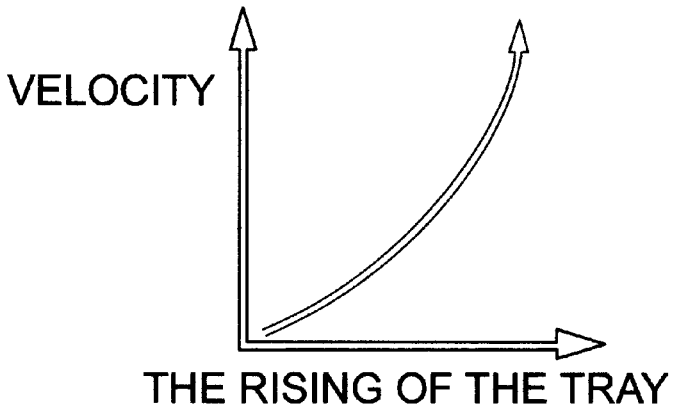
FIG. 7A is a graph showing the increase in velocity of a tray as the tray rises in a conventional paper feeding device.

When a stack of paper P is placed on tray 22, elastic member 23 is compressed and piston 73 of air damper 70 is depressed towards bore 72. While not loading paper P into the electrophotographic device, push down lever 25 braces the tray 22 in position. Once the lever 25 is rotated, the elastic member 23 forces the tray 22 towards the pick-up 24 roller and paper P loaded from tray 22 into the electrophotographic device. When the tray 23 is pushed upwards from the base 21*a* of the frame 21, the tray 22 undergoes an accelerating force that can be described as, F=m*a (accelerating force is equal to the mass of the tray and the stacked paper multiplied by the acceleration). Accordingly, the tray 22 accelerates at a rate equal to the force exerted by the spring or elastic member 23 divided by the mass of the tray 22 and paper P combined. As the tray 22 moves towards the pick-up roller the velocity of the tray 22 would increase if the air damper 70 was not attached to the tray 22, as shown in FIG. 7A. Thus a sheet loading device without an air damper would undergo increased velocity during the paper loading process that would result in increased vibration and noise during the paper loading process.

Figure 7B:
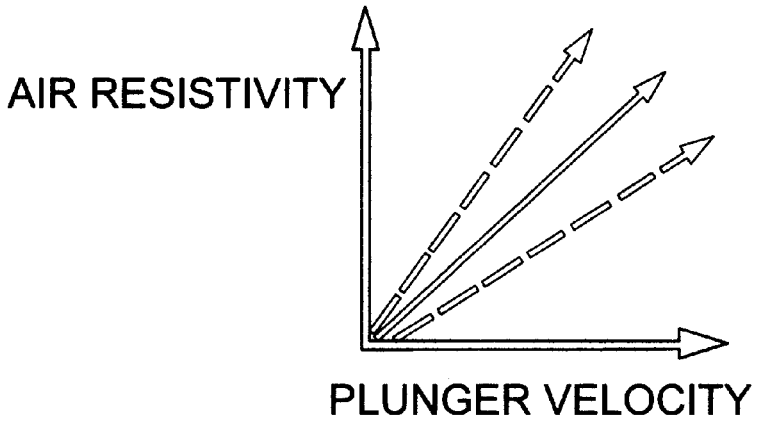
FIG. 7B is a graph showing how the greater the resistivity of the air damper the lower the velocity of the plunger.
Figure 7C:
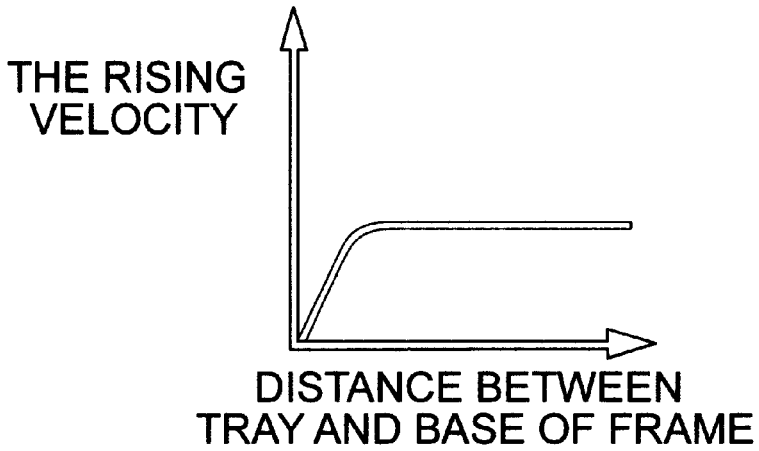
FIG. 7C is a graph showing how the velocity of the tray of the present invention does not increase beyond a predetermined point due to the damping provided by the air damper.

However, when an air damper is integrated with the sheet feeding device, the velocity of the tray is damped. As shown in FIG. 7B, the greater the resistance provided by the air damper 70 the slower the velocity of the plunger 73*a*, and the associated tray 22. As tray 22 goes up, piston 73 connected to the cylindrical boss 74 goes up, and air damper 70 provides resistance. As shown in FIG. 7C, the air damper 70 results in the velocity of the tray 22 reaching equilibrium and thus lowering the speed at which the tray 22, and associated paper P, meets the pick-up roller 24. This results in a reduction in the shock that the sheet feeding device undergoes during the sheet loading process and also reduces noise.

In addition, lubricant L can be used to create an air tight seal between the plunger 73*a* and the inner surface 76 of the circular tube 71. The rising velocity of tray 22 can be adjusted by adjusting the size of bore 72 and thus the damping force exerted by the air damper 70.

As explained above, the present invention minimizes shock, and associated noises, that occur when the pick-up roller contacts the tray. Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A paper feeding device for an electrophotographic apparatus, comprising:

a frame having a base;

a tray pivotally mounted to said base in said frame, said tray for supporting a plurality of cut sheets of paper for feeding into said electrophotographic apparatus;

an elastic member mounted between said base of said frame and said tray, said elastic member for biasing said tray away from said frame; and an air damper recessed into said base of said frame said air damper to reduce vibration associated with sequential loading of said cut sheets of paper into said electrophotographic apparatus.

2. The paper feeding device of claim 1, further comprised of said air damper further comprising:

a circular shaft recessed into said frame;

a first piston pivotally attached to said tray; and said first piston having a second piston on an end of said first piston that maintains contact with an inner surface of said circular shaft.

3. The paper feeding device of claim 2, further comprising a cylindrical boss attached to a lower surface of said tray, said first piston pivotally engaging said cylindrical boss.

4. The paper feeding device of claim 2, further comprised of said circular shaft having a bore in an end opposite from said tray to allow for passage of air.

5. The paper feeding device of claim 2, further comprising a lubricant placed between said inner surface of said circular shaft and said second piston to maintain an air-tight seal.

6. The paper feeding device of claim 1, further comprised of said tray being pivotally connected along a first end of said tray to said frame.

7. The paper feeding device of claim 6, further comprised of said elastic member being attached to said tray proximate to a second end of said tray opposite from said first end of said tray.

8. The paper feeding device of claim 7, further comprising a multi-faced guide attached to said frame proximate to said second end of said tray to align said cut sheets of paper properly during the loading of said cut sheets of paper into said electrophotographic apparatus.

9. The paper feeding device of claim 1, further comprised of said air damper causing said tray to move away from said base of said frame at no more than a predetermined rate.

10. A paper feeding device for an electrophotographic apparatus, comprising:

a frame having a base;

a tray pivotally mounted to said base of said frame, said tray for supporting a plurality of cut sheets of paper for feeding into said electrophotographic apparatus;

an elastic member mounted between said base of said frame and said tray, said elastic member for biasing said tray away from said frame; and an air damper recessed into said base of said frame, said air damper to reduce vibration associated with sequential loading of said cut sheets of paper into said electrophotographic apparatus, said air damper comprising:

a circular tube having an opening at one end disposed along said base of said frame;

a first piston pivotally attached to said tray and protruding into said circular tube; and a second piston attached to an end of said first piston and maintaining contact with an inner surface of said circular tube.

11. The paper feeding device of claim 10, further comprising a cylindrical boss attached to a lower surface of said tray, said first piston pivotally engaging said cylindrical boss.

12. The paper feeding device of claim 10, further comprised of said tray being pivotally connected along a first end of said tray to said frame.

13. The paper feeding device of claim 12, further comprised of said elastic member being attached to said tray proximate to a second end of said tray opposite from said first end of said tray.

14. The paper feeding device of claim 13, further comprising a multi-faced guide attached to said frame proximate to said second end of said tray to align said cut sheets of paper properly during the loading of said cut sheets of paper into said electrophotographic apparatus.

15. The paper feeding device of claim 10, further comprised of said air damper causing said tray to move away from said base of said frame at no more than a predetermined velocity.

16. The paper feeding device of claim 15, further comprised of said circular tube having a bore in an end opposite from said opening of said circular tube to allow for passage of air.

17. The paper feeding device of claim 16, further comprising a lubricant placed between said inner surface of said circular tube and said second piston to maintain an air-tight seal.

18. A method for damping vibration associated with loading of paper in an electrophotographic apparatus, comprising the steps of:

pivotally mounting a tray for supporting said paper to a base in a frame in said electrophotographic apparatus;

biasing said tray away from said frame by an elastic member mounted between said base of said frame and said tray; and damping vibration associated with sequential loading of said paper into electrophotographic apparatus by an air damper recessed into said base of said frame.

19. The method of claim 18, further comprised of said air damper causing movement of said tray away from said base of said frame at no more than a predetermined rate.

20. The method of claim 18, further comprised of said air damper causing movement of said tray away from said base of said frame at no more than a predetermined velocity.

* * * * *